US010148034B2

(12) United States Patent
Lyon et al.

(10) Patent No.: US 10,148,034 B2
(45) Date of Patent: Dec. 4, 2018

(54) ARCLESS POWER CONNECTOR

(71) Applicant: TE CONNECTIVITY CORPORATION, Berwyn, PA (US)

(72) Inventors: Zachary Wood Lyon, Lewisville, NC (US); Abraham Louis Shocket, Cary, NC (US); Jeremy Christian Patterson, Winston-Salem, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 8 days.

(21) Appl. No.: 15/661,713

(22) Filed: Jul. 27, 2017

(65) Prior Publication Data

US 2018/0034197 A1 Feb. 1, 2018

Related U.S. Application Data

(60) Provisional application No. 62/369,406, filed on Aug. 1, 2016.

(51) Int. Cl.
*H01R 13/53* (2006.01)
*H01R 13/42* (2006.01)
(Continued)

(52) U.S. Cl.
CPC ..... *H01R 13/53* (2013.01); *H01R 13/42* (2013.01); *H01R 13/4361* (2013.01);
(Continued)

(58) Field of Classification Search
CPC .... H01R 13/53; H01R 13/42; H01R 13/4361; H01R 13/436; H01R 13/665;
(Continued)

(56) References Cited

U.S. PATENT DOCUMENTS 4,681,549 A 7/1987 Peterson
5,428,195 A 6/1995 Arnold
(Continued)

FOREIGN PATENT DOCUMENTS

EP 1283565 A2 2/2003
WO 2011124563 A1 10/2011
WO 2013092174 A1 6/2013

OTHER PUBLICATIONS

International Search Report, International Application No. PCT/IB2017/054615, International Filing Date Jul. 28, 2017.

*Primary Examiner* — Renee S Luebke
*Assistant Examiner* — Paul Baillargeon

(57) ABSTRACT

An electrical connector matable to and unmatable from a separable mating electrical connector includes a housing having a terminal channel and an auxiliary terminal channel with a power terminal received in the terminal channel and an auxiliary power terminal received in the auxiliary terminal channel. A TPA device is movably coupled to the housing between an open position and a blocking position for blocking removal of the power terminal from the terminal channel. A protective thermal coupler is held by and movable with the TPA device. The protective thermal coupler has a variable resistive member electrically coupled between the power terminal and the auxiliary power terminal. The variable resistive member provides a shunt so that arcing does not occur when the power terminal is disconnected from the mating power terminal of the mating electrical connector.

20 Claims, 7 Drawing Sheets

(51) Int. Cl.

| | |
|---|---|
| ***H01R 13/66*** | (2006.01) |
| ***H01R 13/703*** | (2006.01) |
| ***H01R 13/639*** | (2006.01) |
| ***H01R 24/28*** | (2011.01) |
| ***H01R 24/76*** | (2011.01) |
| ***H01R 13/436*** | (2006.01) |
| ***H01R 13/713*** | (2006.01) |
| *H01R 13/70* | (2006.01) |
| *H01R 103/00* | (2006.01) |

(52) U.S. Cl.
CPC ..... *H01R 13/665* (2013.01); *H01R 13/7032* (2013.01); *H01R 13/7137* (2013.01); *H01R 24/28* (2013.01); *H01R 24/76* (2013.01); *H01R 13/639* (2013.01); *H01R 13/701* (2013.01); *H01R 2103/00* (2013.01); *H01R 2201/26* (2013.01)

(58) Field of Classification Search
CPC ..... H01R 13/7032; H01R 13/7137; H01R 24/48; H01R 24/76; H01R 2201/26; H01R 13/4362; H01R 43/64; H01R 43/65; H01R 13/639; H01R 13/713; H01R 13/633; H01C 7/10; H01C 7/12; H01C 7/13
See application file for complete search history.

(56) References Cited

U.S. PATENT DOCUMENTS

| | | | | |
|---|---|---|---|---|
| 6,659,783 | B2 | 12/2003 | Copper et al. | |
| 8,827,729 | B2 * | 9/2014 | Gunreben ..... | H01R 13/658 439/188 |
| 9,054,459 | B2 * | 6/2015 | Guillanton ..... | H01R 13/5202 |
| 2008/0142344 | A1 | 6/2008 | Hickam | |
| 2013/0330940 | A1 | 12/2013 | Hasse et al. | |

* cited by examiner

ARCLESS POWER CONNECTOR

CROSS-REFERENCE TO RELATED APPLICATIONS

This application claims the benefit of U.S. Provisional Application No. 62/369,406, filed Aug. 1, 2016, titled "ARCLESS POWER CONNECTOR", the subject matter of which is herein incorporated by reference in its entirety.

BACKGROUND OF THE INVENTION

The subject matter herein relates generally to arcless power connectors.

Contacts carrying significant amounts of power will arc when disconnected. The amount of arc damage experienced by the contacts depends on their physical structure, the load current, the supply voltage, the speed of separation, the characteristics of the load (resistive, capacitive, inductive) as well as other factors.

Future automotive systems are expected to utilize high voltage, such as 48-volt operation or higher, to handle the increasing amount of electrical loads in vehicles. This increased voltage could cause significant arc damage to occur to the present connectors designed for 12-volt operation. Electrical connectors under load could become disengaged, such as during operation of the vehicle, leading to arcing. Conventional electrical connectors used in automotive applications require either that the current be shut off before the contacts are separated or unmated or employ a sacrificial contact portion. Components that ensure shut off of the current may include circuits that shut off the current prior to separation, which may include FET components or may have complex locking features that provide staged unlocking and separation. The cost, space, reliability, safety, performance and complexity of these conventional solutions make them unsuitable for many applications, including automotive electrical systems.

A need remains for electrical connectors for high voltage applications that allow disconnection of a live connection without arcing.

BRIEF DESCRIPTION OF THE INVENTION

In one embodiment, an electrical connector is provided that is matable to and unmatable from a separable mating electrical connector. The electrical connector includes a housing having a terminal channel and an auxiliary terminal channel with a power terminal received in the terminal channel that is matable with and unmatable from a mating power terminal of the mating electrical connector and an auxiliary power terminal received in the auxiliary terminal channel. A terminal position assurance (TPA) device is movably coupled to the housing and movable between an open position and a blocking position. The TPA device blocks removal of the power terminal from the terminal channel when in the blocking position. A protective thermal coupler is held by and movable with the TPA device. The protective thermal coupler has a variable resistive member electrically coupled between the power terminal and the auxiliary power terminal. The variable resistive member provides a shunt so that arcing does not occur when the power terminal is disconnected from the mating power terminal of the mating electrical connector.

In another embodiment, an electrical connector is provided that is matable to and unmatable from a separable mating electrical connector and that includes a housing having a terminal channel and an auxiliary terminal channel. A power terminal is received in the terminal channel that is matable with and unmatable from a mating power terminal of the mating electrical connector. An auxiliary power terminal is received in the auxiliary terminal channel. A terminal position assurance (TPA) device is movably coupled to the housing and movable between an open position and a blocking position. The TPA device blocks removal of the power terminal from the terminal channel when in the blocking position. A protective thermal coupler is held by and movable with the TPA device. The protective thermal coupler has a variable resistive member electrically coupled between the power terminal and the auxiliary power terminal. The power terminal is separable from the mating power terminal before the auxiliary power terminal is disconnected from a circuit including the mating power terminal of the mating electrical connector so that the resistance in the variable resistive member increases after disconnection of the main power terminal from the mating power terminal and prior to disconnection of the auxiliary power terminal from the circuit so that both the main power terminal and the auxiliary power terminal can be disconnected without arcing.

In a further embodiment, an electrical connector is provided that is matable to and unmatable from a separable mating electrical connector and that includes a housing having a terminal channel, an auxiliary terminal channel and a pocket. A power terminal is received in the terminal channel that is matable with and unmatable from a mating power terminal of the mating electrical connector. An auxiliary power terminal is received in the auxiliary terminal channel that is matable with and unmatable from a mating auxiliary terminal of the mating electrical connector. A terminal position assurance (TPA) device is received in the pocket of the housing. The TPA device includes a block having a blocking surface. The TPA device is movably coupled to the housing between an open position and a blocking position. The block of the TPA device is positioned behind the power terminal to block removal of the power terminal from the terminal channel when in the blocking position. A protective thermal coupler is held by and movable with the TPA device. The protective thermal coupler has a first contact coupled to the power terminal and a second contact coupled to the auxiliary power terminal. The protective thermal coupler has a variable resistive member between the first contact and the second contact electrically coupled between the power terminal and the auxiliary power terminal. The variable resistive member provides a variable resistance path through the electrical connector immediately after disconnection of the power terminal from the mating power terminal of the mating electrical connector.

DETAILED DESCRIPTION OF THE INVENTION

Figure 1:
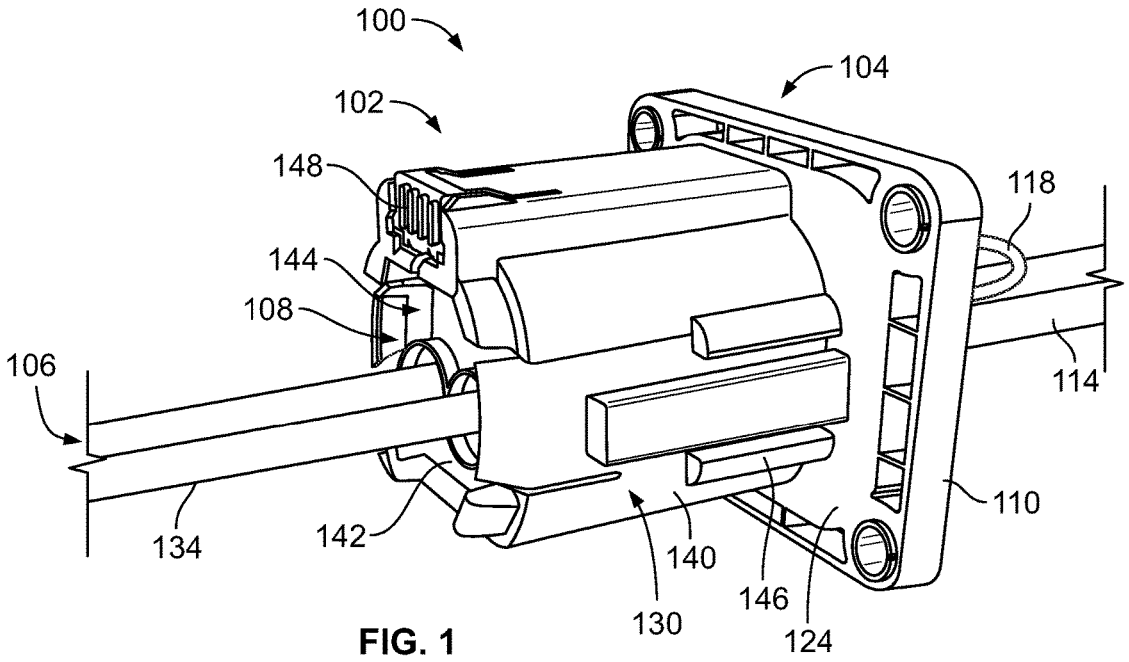
FIG. 1 is a front perspective view of a power connector system formed in accordance with an exemplary embodiment including an electrical connector matable to and unmatable from a mating electrical connector.
Figure 2:
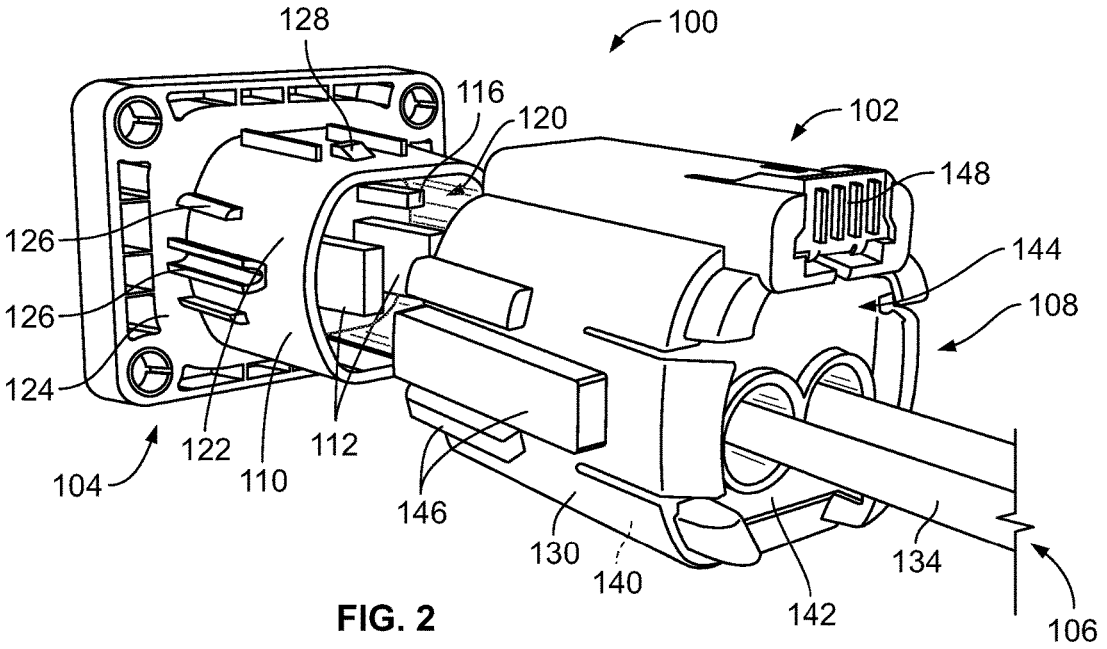
FIG. 2 is a front perspective view of the power connector system showing the electrical connector unmated from the mating electrical connector.
Figure 3:
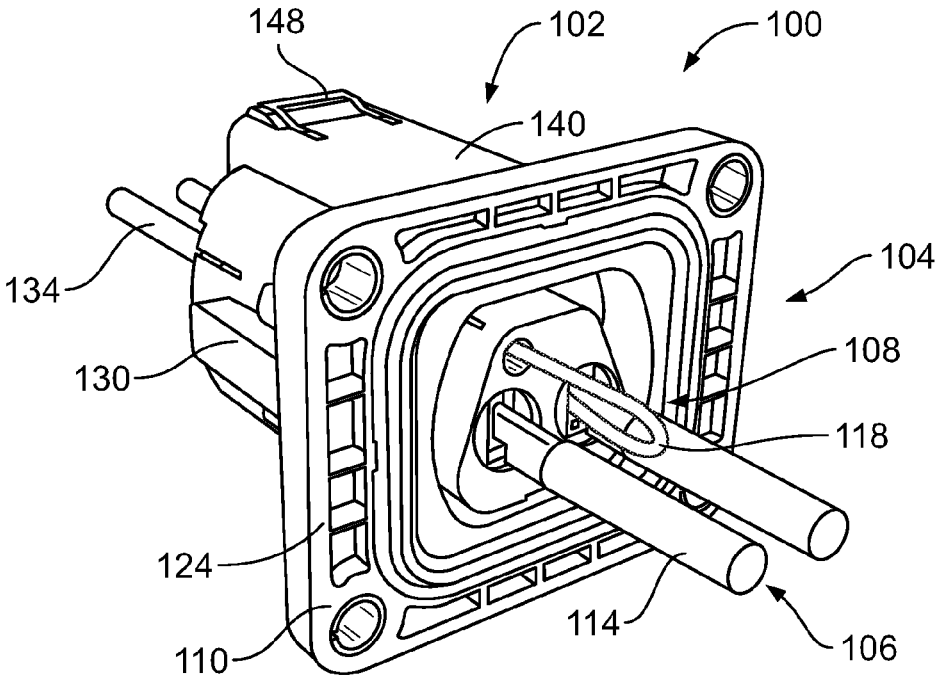
FIG. 3 is a rear perspective view of the power connector system showing the electrical connector mated with the mating electrical connector.

FIG. 1 is a front perspective view of a power connector system 100 formed in accordance with an exemplary embodiment including an electrical connector 102 matable to and unmatable from a mating electrical connector 104. FIG. 2 is a front perspective view of the power connector system 100 showing the electrical connector 102 unmated from the mating electrical connector 104. FIG. 3 is a rear perspective view of the power connector system 100 showing the electrical connector 102 mated with the mating electrical connector 104.

The power connector system 100 includes a main power circuit 106 electrically connected by the electrical connectors 102, 104. In an exemplary embodiment, the main power circuit 106 is a high voltage power circuit, such as a 48 volt DC power circuit; however the main power circuit 106 may be used with any voltage in the system, including a higher voltage. The main power circuit 106 may be used in an automotive application, such as in a vehicle. The power connector system 100 may have application other than automotive applications in alternative embodiments.

The power connector system 100 includes an arc suppression circuit 108 electrically connected between the electrical connectors 102, 104. The arc suppression circuit 108 protects the components of the power connector system 100 from damage due to arcing when the electrical connectors 102, 104 are intentionally or unintentionally disconnected. The arc suppression circuit 108 allows the disconnection of the electrical connectors 102, 104 when the main power circuit 106 has a live connection making the electrical connectors 102, 104 hot swappable. Various embodiments of the arc suppression circuit 108 include a protective thermal coupler. The protective thermal coupler may incorporate a variable resistive member, such as a positive temperature coefficient resistor that varies resistance to current based on temperature.

In the illustrated embodiment, the mating electrical connector 104 is a header connector configured to be mounted to another device, such as a battery or a power distribution unit within a vehicle. The mating electrical connector 104 may be referred to hereinafter as a header connector 104. The electrical connector 102 is configured to be plugged into the header connector 104. The electrical connector 102 thus defines a plug connector and may be referred to hereinafter as plug connector 102.

The header connector 104 includes a header housing 110 holding a plurality of mating power terminals 112, which may also be referred to hereinafter as header power terminals 112. The mating power terminals 112 are electrically connected to corresponding mating power wires 114. The mating power terminals 112 and the mating power wires 114 define portions of the main power circuit 106. In an exemplary embodiment, the mating electrical connector 104 includes a mating auxiliary terminal 116 terminated to an auxiliary power wire 118. The mating auxiliary terminal 116 and the auxiliary power wire 118 define portions of the arc suppression circuit 108. The auxiliary power wire 118 extends from the header housing 110. Optionally, the auxiliary power wire 118 may be electrically connected to the auxiliary power terminal 112 and/or one of the mating power wires 114. For example, the mating power wire 114 and the auxiliary power wire 118 may both be co-crimped in the auxiliary power terminal 112. In alternative embodiments, rather than having an auxiliary power wire 118, the mating auxiliary terminal 116 may be directly connected to one of the mating power terminals 112.

In the illustrated embodiment, the mating power terminals 112 are blade terminals; however, other types of terminals may be used in alternative embodiments. In the illustrated embodiment, the mating auxiliary terminal 116 may be a pin terminal; however, other types of auxiliary terminals may be used in alternative embodiments, such as a blade terminal, a receptacle terminal, or another type of terminal.

The header housing 110 includes a cavity 120 surrounded by a shroud wall 122. The header housing 110 includes a mounting flange 124 extending outward from the shroud wall 122. The mounting flange 124 may be used to mount the header housing 110 to another component, such as the battery or power distribution unit of the vehicle. In an exemplary embodiment, the header housing 110 includes one or more guide features 126 to guide mating with the electrical connector 102. In the illustrated embodiment, the guide features 126 are ribs extending from the shroud wall 122. Other types of guide features may be used in alternative embodiments, such as slots, keys, or other types of guide features. In an exemplary embodiment, the header housing 110 includes a securing feature 128 to secure the electrical connector 102 to the mating electrical connector 104. In the illustrated embodiment, the securing feature 128 is a catch extending from the shroud wall 122; however, other types of securing features may be used in alternative embodiments, such as a latch.

Figure 5:
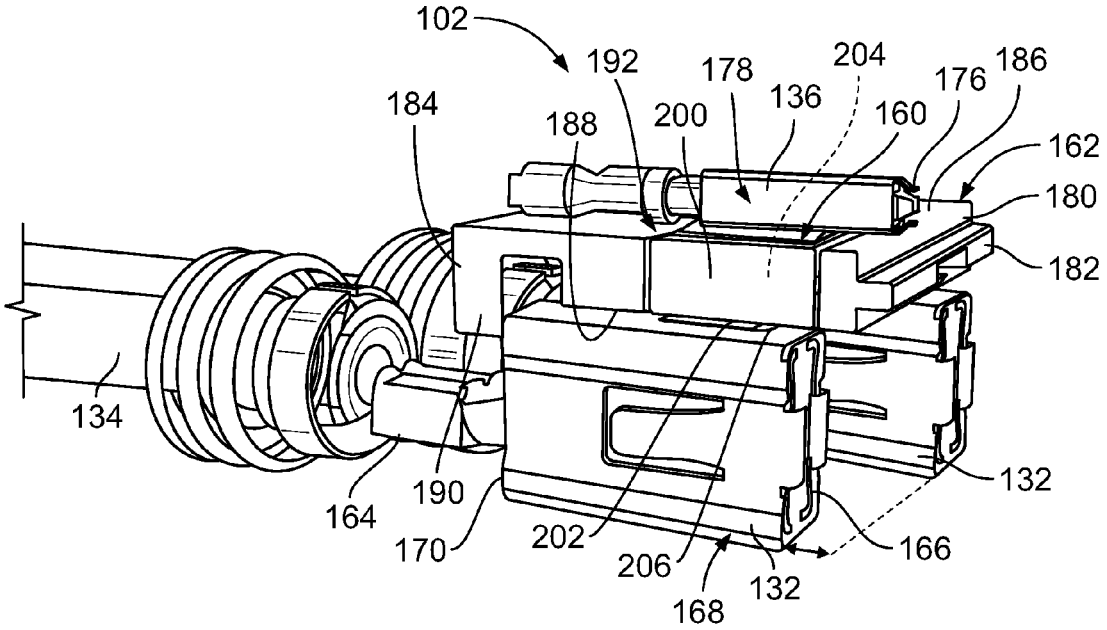
FIG. 5 is a perspective view of a portion of the electrical connector.

The electrical connector 102 includes a housing 130 holding a plurality of power terminals 132 (shown in FIG. 5). The power terminals 132 are electrically connected to corresponding power wires 134. The power terminals 132 and the power wires 134 define portions of the main power circuit 106. In an exemplary embodiment, the electrical connector 102 includes an auxiliary terminal 136 (shown in FIG. 5) defining a portion of the arc suppression circuit 108. The auxiliary terminal 136 may be electrically connected to the mating auxiliary terminal 116. The auxiliary terminal 136 may be shunted to one of the power terminals 132.

The housing 130 may be a multi-piece plug housing. For example, in the illustrated embodiment, the electrical connector 102 includes an outer housing 140 and an inner housing 142. The inner housing 142 defines part of a terminal assembly 144 of the electrical connector 102. The terminal assembly 144 is received in the outer housing 140. The terminal assembly 144 includes the power terminals 132 and the auxiliary power terminal 136. The terminal assembly 144 is configured to be received in the cavity 120 of the header housing 110. In an exemplary embodiment, the outer housing 140 of the electrical connector 102 surrounds the shroud wall 122 such that a portion of the header connector 104 is received in the electrical connector 102.

In an exemplary embodiment, the electrical connector 102 includes guide features 146 that interact with the guide features 126 of the mating electrical connector 104 to guide mating of the electrical connector 102 with the mating electrical connector 104. For example, the guide features 146 may be slots that receive the ribs of the mating electrical connector 104. Other types of guide features 146 may be provided in alternative embodiments. In an exemplary embodiment, the electrical connector 102 includes a securing feature 148 for securing the electrical connector 102 to the mating electrical connector 104. In the illustrated embodiment, the securing feature 148 is a latch; however, other types of securing features may be used in alternative embodiments.

Figure 4:
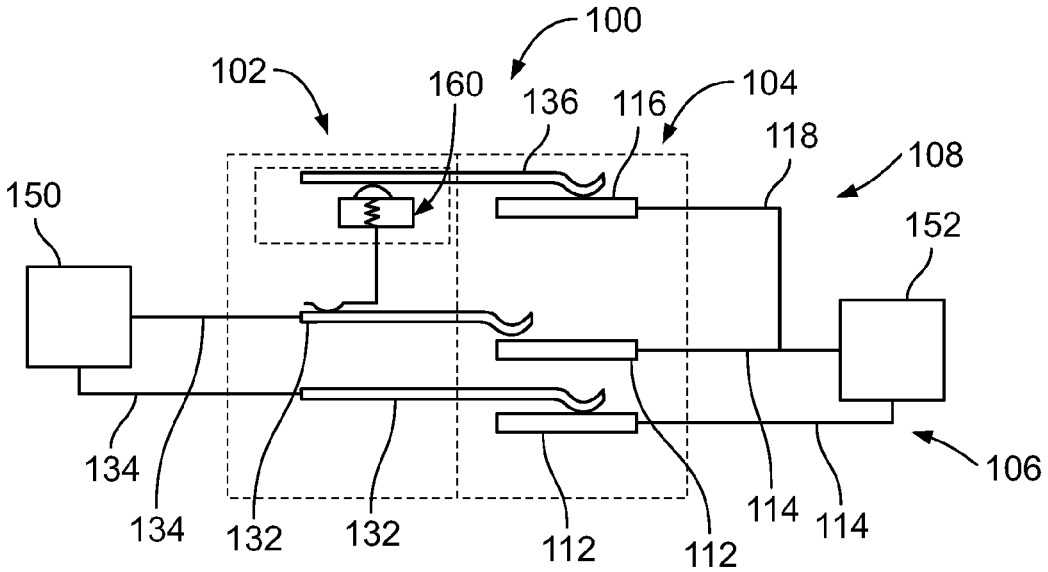
FIG. 4 is a schematic illustration of the power connector system in accordance with an exemplary embodiment.

FIG. 4 is a schematic illustration of the power connector system 100. FIG. 4 illustrates the components of the main power circuit 106 and the components of the arc suppression circuit 108. FIG. 4 shows the power terminals 132 of the electrical connector 102 connected to the mating power terminals 112 of the mating electrical connector 104 (first and second power terminals 132 and first and second mating power terminals 112 are illustrated in FIG. 4; however any number of such terminals may be provided in various embodiments). FIG. 4 shows the auxiliary power terminal 136 of the electrical connector 102 connected to the mating auxiliary terminal 116 of the mating electrical connector 104 and the auxiliary power wire 118. FIG. 4 shows the power wires 134 connected to a load 150 and the mating power wires 114 connected to a power supply 152, such as a battery; however the power wires 134 may be connected to the power supply 152 and the mating power wires 114 may be connected to the load 150 in alternative embodiments.

The arc suppression circuit 108 includes a protective thermal coupler (PTC) 160 in the electrical connector 102 electrically coupled to the auxiliary power terminal 136, the combination of which is in parallel with the main power terminal 132. In an exemplary embodiment, the power terminal 132 is configured to disconnect first (e.g., the power terminal 132 is staggered or recessed rearward, is shorter or the mating power terminal 132 may be staggered or recessed). In an exemplary embodiment, the arrangement of components parts and incorporation of the PTC 160 prevent arcing when the electrical connectors 102, 104 are unmated while carrying current. In the illustrated embodiment, the PTC 160 is only employed in the electrical connector 102; however, the PTC 160 may additionally or alternatively be employed in the mating electrical connector 104.

In an exemplary embodiment, the PTC 160 includes a variable resistive member. The variable resistive member may be a conductive polymer member in which conductive particles are contained within a polymer matrix. Normally, the conductive particles form a conductive path that have a resistance that is larger than the resistance of the power terminal 132 so that under normal mated operation, the power terminal 132 would carry substantially all of the current. However, as current increases in the PTC 160, the polymer expands and the resistance increases. When current through the PTC 160 increases rapidly due to disconnection of the main power terminal 132, the resistance will increase rapidly due to resistive ($I^2R$) heating of the polymer. To prevent arcing when the power terminal 132 is unmated, the disconnect time for the power terminal 132 must be less than the time for the resistance of the PTC 160 to increase too greatly. Most of the current through the power terminal 132 must be carried by the PTC 160 and the auxiliary power terminal 136 until the power terminal 132 has moved to a position in which arcing is no longer possible. Before the auxiliary power terminal 136 is disconnected from the mating auxiliary terminal 116, the resistance in the PTC 160 must increase so that the current flow through the auxiliary power terminal 136 will drop below the arcing threshold before the auxiliary power terminal 136 is unmated. This time is called the trip time of the variable resistive member. Since the trip time of the PTC 160 will depend on the initial current through the power terminal 136, which can vary over a wide range, the trip time for a given electrical connector will therefore not be constant. The PTC 160 may be automatically resettable.

When the electrical connectors 102, 104 are fully mated and during normal operation, the power terminal 132 is carrying a high current. The current is primarily flowing between the power terminal 132 and the mating power terminal 112. Only a relatively small shunt current flows through the auxiliary portion or arc suppression circuit 108 (e.g., the auxiliary power terminal 136, mating auxiliary terminal 116 and the PTC 160). During unmating, the first power terminal 132 separates and is disconnected from the mating power terminal 112. It is while the terminals 132, 112 are in this initial disconnect state that arcing between the two electrical connectors 102, 104 is most likely when the voltage and current are above an arcing threshold, since a relatively large existing current is being disconnected. However, the PTC 160 limits the voltage and current across the opening gap to prevent arcing. The two terminals 132, 112 may not be completely separated during the initial disconnect, but rather may be subject to separation from contact bounce as spring members flex and as irregular surfaces on the terminals result in momentary separation and engagement. The duration of unmating should be less than the trip time for the PTC 160 so that the PTC 160 does not switch to an OFF or open condition before completion of the separation between the terminals 132, 112.

When the terminals 132, 112 initially physically separate, the variable resistive member of the PTC 160 has a low resistance state since there was only a small amount of current flowing through the PTC 160 prior to separation, causing the resistive heating of the variable resistive member to remain low. Since the resistance is relatively low, current flows through the PTC 160 to the auxiliary power terminal 136. The PTC 160 acts like a switch by varying the resistance (e.g., based on temperature). In the low resistance state, the PTC 160 can be said to be ON. While the auxiliary power terminal 136 remains connected to the mating auxiliary terminal 116 of the mating electrical connector 104, the current through the PTC 160 and the auxiliary power terminal 136 will increase and therefore resistive heating of the variable resistive member will increase. The resistance of the variable resistive member increases with increasing temperature. As the resistance increases, the PTC 160 will effectually open or, in other words, its resistance will significantly increase to a point where the circuit is no longer effectively conducting power. In such state, the PTC switch is said to be in the OFF position.

Prior to the time that the auxiliary power terminal 136 separates from the mating auxiliary terminal 116, the current flowing through the auxiliary power terminal 136 will be below the arcing threshold. This is due to the increased resistance of the PTC 160 during the time when relative movement of the electrical connectors 102, 104 occurs. When the mating auxiliary terminal 116 finally separates, there may only be a small amount of leakage current flowing through the electrical connectors 102, 104. At this point there will be insufficient electrical energy to support an arc between the auxiliary contact portions. The amount of time that elapses while the electrical connectors 102, 104 are unmating allows the current to fall below the arcing threshold before the auxiliary power terminal 136 is physically disconnected from the mating auxiliary terminal 116. Since current is no longer flowing through the electrical connectors 102, 104, the PTC 160 will return or reset to a state of lower temperature and resistance.

Figure 6:
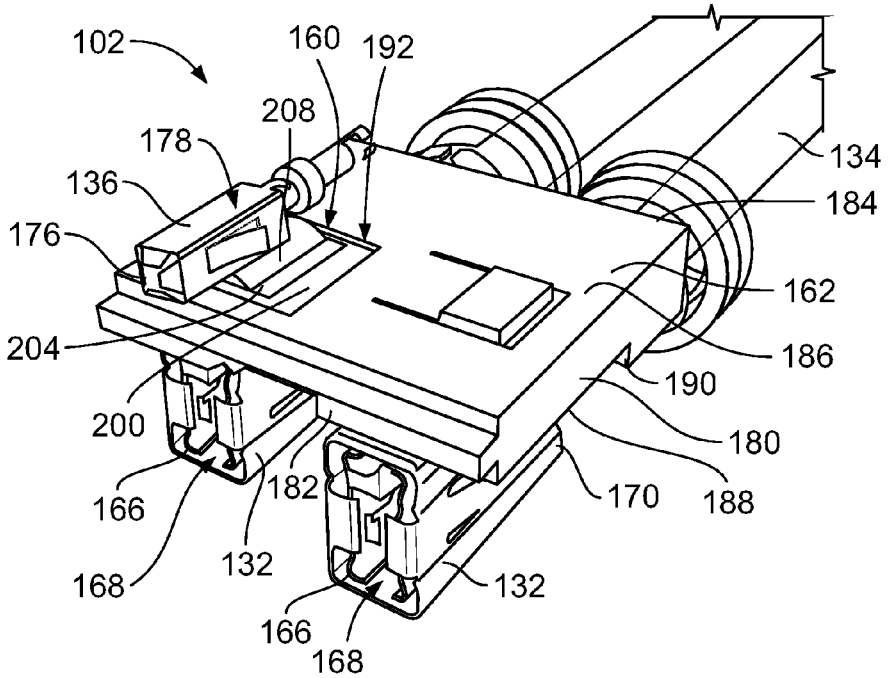
FIG. 6 is a front perspective view of a portion of the electrical connector.

FIG. 5 is a perspective view of a portion of the electrical connector 102 with the housing 130 (shown in FIG. 1) removed to illustrate the power terminals 132, the auxiliary power terminal 136, the PTC 160 and a terminal position assurance (TPA) device 162. FIG. 6 is a front perspective view of a portion of the electrical connector 102 with the housing 130 removed showing the power terminals 132, the auxiliary power terminal 136, the PTC 160 and the TPA device 162.

The power terminals 132 are terminated to corresponding power wires 134. For example, the power terminals 132 may be crimped to the power wires 134. The power terminals 132 may be terminated by other means in alternative embodiments. Both the power terminals 132 and the auxiliary power terminal 136 may be held within the housing 130 and positioned for mating with the corresponding mating electrical connector 104 (shown in FIG. 1).

The power terminals 132 have terminating ends 164 and mating ends 166 opposite the terminating ends 164. The terminating ends 164 are terminated to corresponding power wires 134. In an exemplary embodiment, the power terminals 132 include sockets 168 at the mating ends 166 configured to receive corresponding mating power terminals 112 (shown in FIG. 2). The power terminals 132 may have spring beams or other features that extend into the sockets 168 to engage the mating power terminals 112. In an exemplary embodiment, the mating ends 166 of the first and second power terminals 132 are offset or staggered with the mating end 166 of the first power terminal 132 positioned rearward of the mating end 166 of the second power terminal 132. Having the mating ends 166 staggered allows for sequenced mating and unmating. The sockets 168 extend to rear ends 170. Optionally, the rear ends 170 may also be staggered.

The auxiliary power terminal 136 has a mating end 176. In an exemplary embodiment, the auxiliary power terminal 136 includes a socket 178 at the mating end 176 configured to receive the mating auxiliary terminal 116 (shown in FIG. 2). The auxiliary power terminal 136 may have spring beam(s) or other features that extend into the socket 178 to engage the mating auxiliary terminal 116. In an exemplary embodiment, the mating end 176 of the auxiliary power terminal 136 is offset or staggered with respect to the mating end 166 of the first power terminal 132 forward of the mating end 166 of the first power terminal 132. Having the mating end 176 forward of the mating end 166 allows for sequenced mating and unmating.

The TPA device 162 includes a body 180 extending between a front end 182 and a back end 184. The body 180 includes a first or top side 186 and a second or bottom side 188. The TPA device 162 may have any size or shape depending on the particular application. In the illustrated embodiment, the TPA device 162 is thin and configured to be positioned between the power terminals 132 and the auxiliary power terminal 136. Other configurations are possible in alternative embodiments. The TPA device 162 is configured to be positioned behind the power terminals 132 to block removal of the power terminals 132 from the housing. In the illustrated embodiment, the TPA device 162 is positioned above the power terminals 132. The TPA device 162 includes blocks 190 extending from the bottom side 188 that are configured to be positioned behind the rear ends 170 of the sockets 168 of the power terminals 132 to block removal of the power terminals 132. In an exemplary embodiment, the TPA device 162 includes a pocket 192 that receives the PTC 160.

The TPA device 162 may be positioned in a clearance or an open position where the TPA device 162 does not block the power terminals 132, such as to allow removal of the power terminals 132 or to allow loading of the power terminals 132 into the housing. The TPA device 162 may then be moved to a closed or a blocking position where the blocks 190 block removal of the power terminals 132.

In an exemplary embodiment, the PTC 160 is held by the TPA device 162 in the pocket 192. The pocket 192 may be sized to allow the TPA device to expand, such as when heated. The PTC 160 is movable with the TPA device 162 between the open and blocking positions. The PTC 160 is configured to be positioned relative to the power terminal 132 and the auxiliary power terminal 136. When the TPA device 162 is moved to the blocking position, the PTC 160 is electrically connected to the power terminal 132 and is electrically connected to the auxiliary power terminal 136. Optionally, when the TPA device 162 is moved to the open position, the PTC 160 is electrically separated from the power terminal 132 and/or the auxiliary power terminal 136.

In an exemplary embodiment, the PTC 160 includes a variable resistive member 200 configured to vary resistance from a low resistance state to a high resistance state to operate as a switch to reduce the flow of current through the PTC 160. Optionally, the variable resistive member 200 may vary resistance with temperature. In an exemplary embodiment, the PTC 160 includes a first contact 202 electrically connected to the variable resistive member 200 and configured to be electrically connected to the power terminal 132. The PTC 160 includes a second contact 204 electrically connected to the variable resistive member 200 and configured to be electrically connected to the auxiliary power terminal 136. The variable resistive member 200 creates a variable resistance path between the first and second contacts 202, 204.

The first contact 202 includes a spring beam 206 configured to be resiliently deflected against the power terminal 132. The second contact 204 includes a spring beam 208 configured to be resiliently deflected against the auxiliary power terminal 136. The spring beams 206, 208 allow expansion and contraction of the variable resistive member 200 therebetween. The pocket 192 is also sized to allow expansion and contraction of the variable resistive member 200.

In an exemplary embodiment, the variable resistive member 200 includes a positive temperature coefficient resistive member that varies resistance based on temperature. For example, the resistance may increase as the temperature increases. The variable resistive member 200 includes a conductive polymer member with conductive particles immersed in a non-conductive polymer. Increased resistive heating caused by current flowing through the variable resistance path of the variable resistive member 200 causes the non-conductive polymer to expand to disrupt conductive paths formed by interconnected conductive particles.

The variable resistive member 200 is characterized in that an increase in electrical resistance of the variable resistive member 200 lags an inrush current through the variable resistive member 200 so that the variable resistive member carries a current approximately equal to the inrush current for a period of time referred to as a trip time. The trip time is the time it takes for the non-conductive polymer to expand to a point that the conductive paths formed by the interconnected conductive particles to no longer carry enough current to sustain arcing, thus having a current that is below an arcing threshold so that arcing does not occur upon disconnection of the electrical connectors 102, 104. The trip time is long enough for resistance in the variable resistive member 200 to increase sufficiently to reduce the current through the variable resistive path through the variable resistive member 200 below the arcing threshold so that arcing does not occur. The trip time is long enough to allow the variable resistive member 200 to switch from a first relatively low resistance state to a second relatively higher resistance state. In an exemplary embodiment, the resistance of the positive temperature coefficient resister increases sufficiently rapidly between separation of the power terminal 132 and disconnection of the auxiliary power terminal 136 so that the electrical energy flowing through the auxiliary power terminal 136 is reduced below an arcing threshold after separation of the power terminal 132 and before disconnection of the auxiliary power terminal 136.

Figure 7:
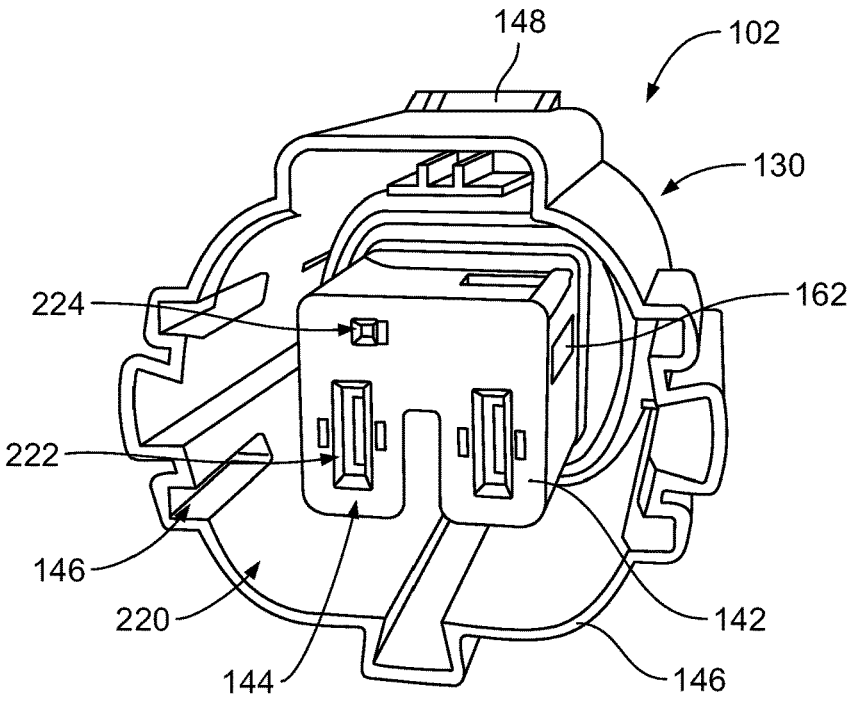
FIG. 7 is a front perspective view of the electrical connector showing a TPA device in a blocking position.
Figure 8:
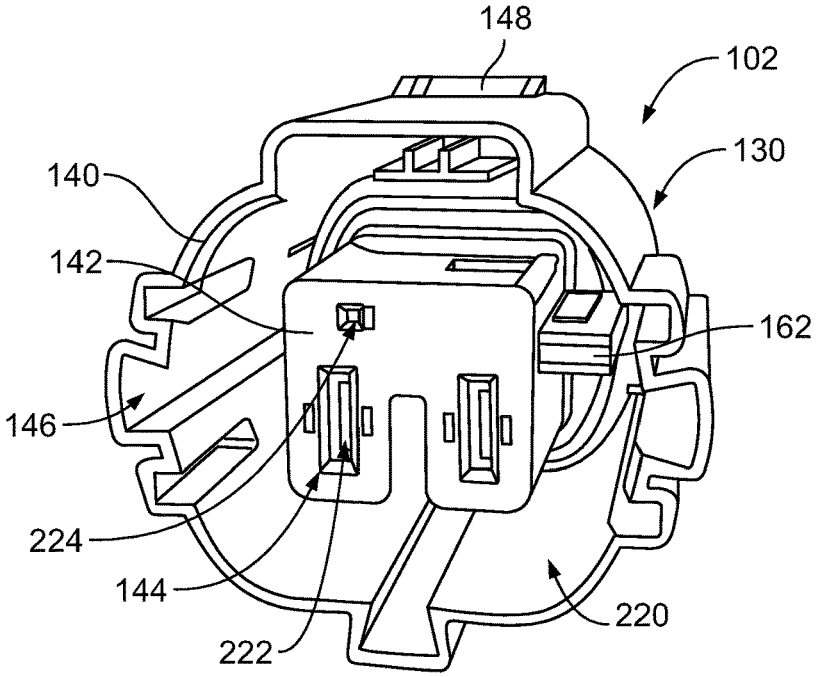
FIG. 8 is a front perspective of the electrical connector showing the TPA device in an open position.

FIG. 7 is a front perspective view of the electrical connector 102 showing the TPA device 162 in a blocking position. FIG. 8 is a front perspective of the electrical connector 102 showing the TPA device 162 in an open position. The guide features 146 and the securing feature 148 are illustrated in FIGS. 7 and 8.

In the open position (FIG. 8), the TPA device 162 allows the power terminals 132 to be unloaded from the housing 130 and loaded into the housing 130. After the power terminals 132 are loaded into the housing 130, the TPA device 162 may be moved to the blocking position (FIG. 7) to block removal of the power terminals 132.

The terminal assembly 144 is positionable in the outer housing 140. In an exemplary embodiment, the outer housing 140 includes a chamber 220. The terminal assembly 144 is positioned in the chamber 220. A space is defined between the inner housing 142 of the terminal assembly 144 and the outer housing 140. Such space is configured to receive the mating electrical connector 104 (shown in FIG. 1). In an exemplary embodiment, the TPA device 162 is positioned in such space prior to moving to the blocking position. When the TPA device 162 is in the open position in the space between the inner housing 142 and the outer housing 140, the TPA device 162 blocks loading of the mating electrical connector 104 into the chamber 220. As such, mating of the electrical connector 102 and the mating electrical connector 104 is restricted until the TPA device 162 is properly positioned in a blocking position behind the power terminals 132.

In an exemplary embodiment, the inner housing 142 includes terminal channels 222 that receive corresponding power terminals 132 and an auxiliary terminal channel 224 that receives the auxiliary power terminal 136. The power terminals 132 and auxiliary power terminal 136 may be loaded into the corresponding terminal channels 222 and auxiliary terminal channel 224 through the rear of the inner housing 142. The power terminals 132 and auxiliary power terminal 136 may be held in the corresponding terminal channels 222 and auxiliary terminal channel 224 by latches or other securing features. The TPA device 162 may act as a secondary securing feature to secure the power terminals 132 in the corresponding terminal channels 222.

Figure 9:
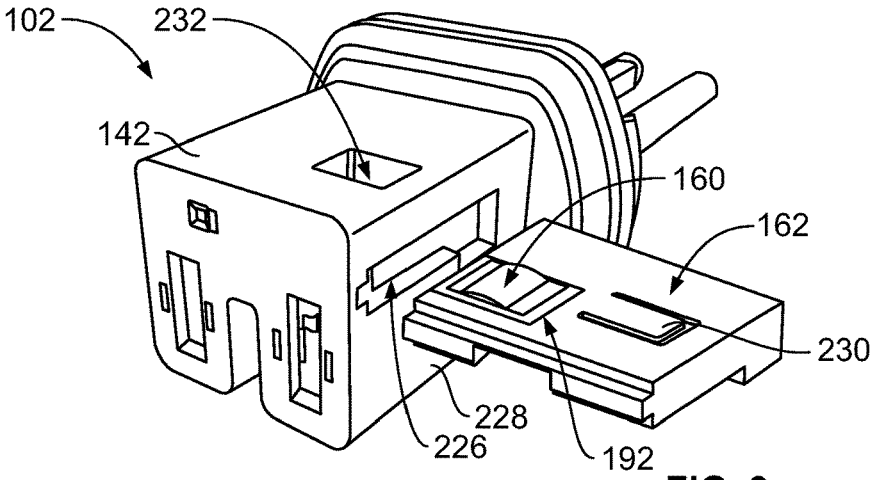
FIG. 9 illustrates a portion of the electrical connector.
Figure 10:
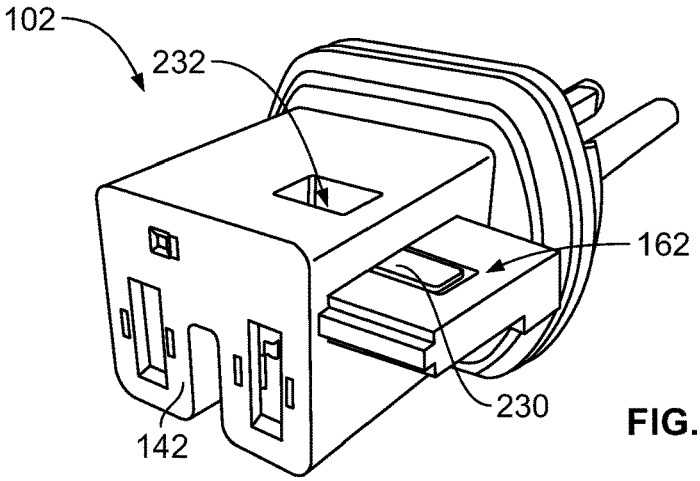
FIG. 10 illustrates a portion of the electrical connector showing the TPA device in an open position.
Figure 11:
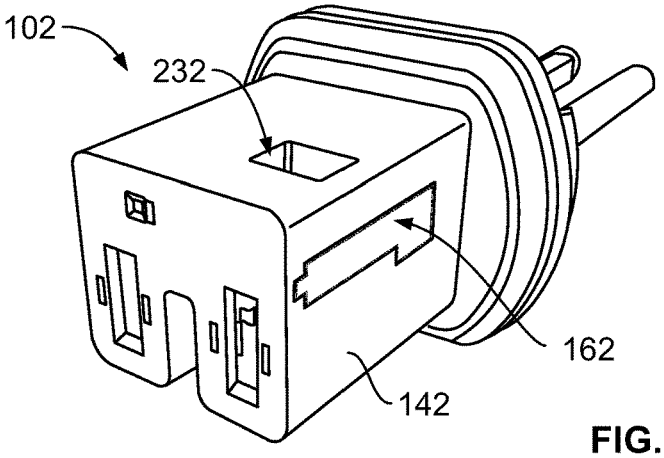
FIG. 11 illustrates a portion of the electrical connector showing the TPA device in a blocking position.

FIG. 9 illustrates a portion of the electrical connector 102 showing the TPA device 162 being loaded into a pocket 226 in a side 228 of the inner housing 142. FIG. 10 illustrates a portion of the electrical connector 102 showing the TPA device 162 in an open position. FIG. 11 illustrates a portion of the electrical connector 102 showing the TPA device 162 in a blocking position within the inner housing 142. The PTC 160 is held by the TPA device 162 in the pocket 192. The PTC 160 may be loaded into the inner housing 142 with the TPA device 162. The PTC 160 is movable with the TPA device 162 during loading as the TPA device 162 moves from the open position to the blocking position.

The TPA device 162 includes a latch 230 used to secure the TPA device 162 in the blocking position. The latch 230 may be released by inserting a tool in a release opening 232 in the inner housing 142. The TPA device 162 may be released to separate the PTC 160 from the power terminal 132 and/or the auxiliary power terminal 136 (both shown in FIG. 5).

Figure 12:
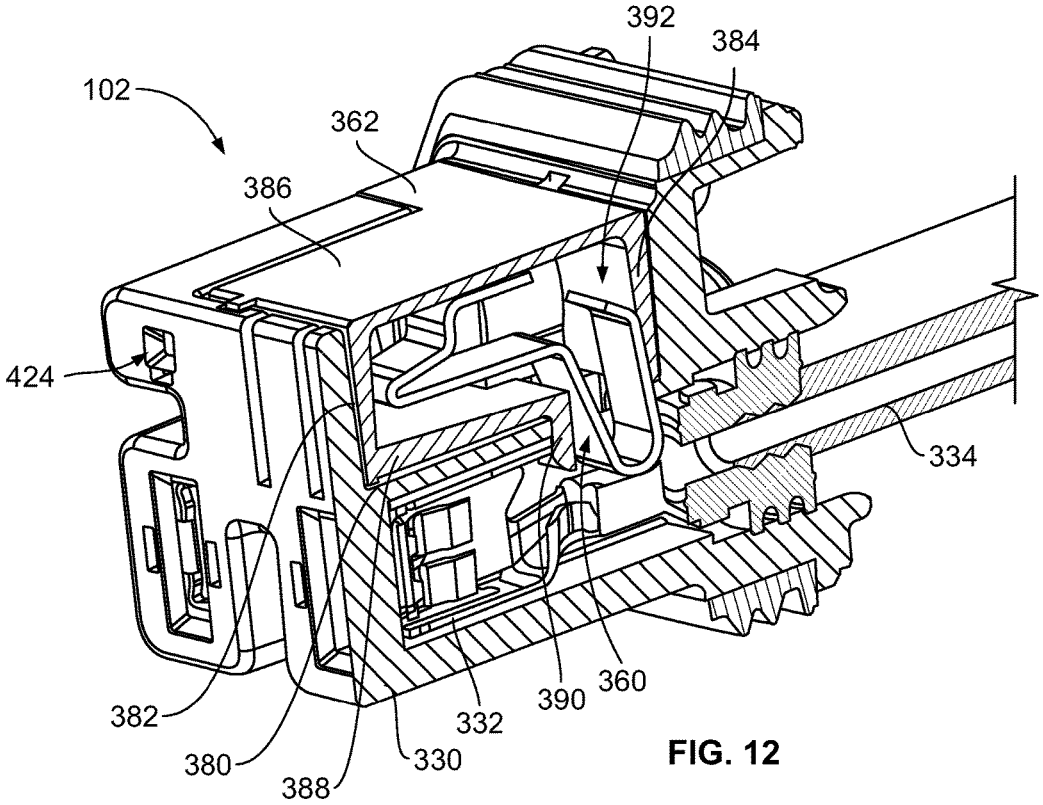
FIG. 12 is a partial sectional view of an electrical connector in accordance with an exemplary embodiment.

FIG. 12 is a partial sectional view of an electrical connector 302 in accordance with an exemplary embodiment. The electrical connector 302 may be used with the power connector system. The electrical connector 302 is configured to be coupled to a corresponding mating or header connector. The electrical connector 302 may include similar features as the electrical connector 102 (shown in FIG. 1) and not all like components are described herein. The electrical connector 302 includes components forming part of a main power circuit and an arc suppression circuit.

The electrical connector 302 includes a housing 330 holding a plurality of power terminals 332. The power terminals 332 are electrically connected to corresponding power wires 334. In an exemplary embodiment, the electrical connector 302 includes an auxiliary terminal (not shown), which may be similar to the auxiliary terminal 136 (shown in FIG. 5). The housing 330 may be a multi-piece plug housing and may include an outer housing, similar to the outer housing 140 (shown in FIG. 1) that surrounds the housing 330.

The electrical connector 302 includes a protective thermal coupler (PTC) 360 that is carried by a TPA device 362. In an exemplary embodiment, the PTC 360 includes a variable resistive member. The PTC 360 may operate in a similar manner as the PTC 160 described above to suppress arcing and prevent damage to the components of the electrical connector 302. When current through the PTC 360 increases rapidly due to disconnection of the main power terminal 332, the resistance will increase rapidly due to resistive ($I^2R$) heating of the polymer. Most of the current through the power terminal 332 must be carried by the PTC 360 and the auxiliary power terminal until the power terminal 332 has moved to a position in which arcing is no longer possible.

The TPA device 362 includes a body 380 extending between a front end 382 and a back end 384. The body 380 includes a first or top side 386 and a second or bottom side 388. The TPA device 362 may have any size or shape depending on the particular application. The TPA device 362 is configured to be positioned behind the power terminals 332 to block removal of the power terminals 332 from the housing. In the illustrated embodiment, the TPA device 362 is positioned above the power terminals 332. The TPA device 362 includes blocks 390 extending from the bottom side 388 that are configured to be positioned behind the power terminals 332 to block removal of the power terminals 332. In an exemplary embodiment, the TPA device 362 includes a pocket 392 that receives the PTC 360.

Figure 13:
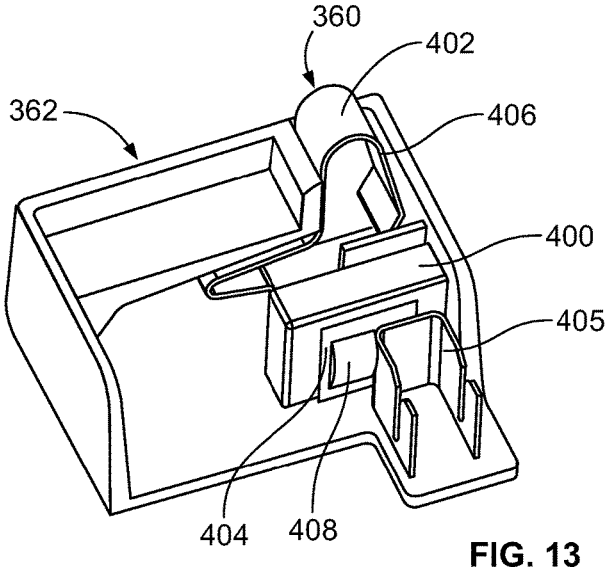
FIG. 13 is a bottom perspective view of a portion of the electrical connector shown in FIG. 12.

FIG. 13 is a bottom perspective view of a portion of the electrical connector 302 showing the PTC 360 and the TPA device 362. In an exemplary embodiment, the PTC 360 is held by the TPA device 362 in the pocket 392. The pocket 392 may be sized to allow the TPA device to expand, such as when heated. In an exemplary embodiment, the PTC 360 includes a variable resistive member 400 configured to vary resistance from a low resistance state to a high resistance state to operate as a switch to reduce the flow of current through the PTC 360. Optionally, the variable resistive member 400 may vary resistance with temperature. In an exemplary embodiment, the PTC 360 includes a first contact 402 electrically connected to the variable resistive member 400 and configured to be electrically connected to the power terminal 332. For example, the first contact 402 may directly engage the variable resistive member 400 or may be electrically connected thereto by another component, such as a spring contact. The PTC 360 includes a second contact 404 electrically connected to the variable resistive member 400 and configured to be electrically connected to an insulation displacement contact (IDC contact) 405. The IDC contact 405 is configured to be electrically connected to the auxiliary power terminal. The variable resistive member 400 creates a variable resistance path between the first and second contacts 402, 404.

The first contact 402 includes a spring beam 406 configured to be resiliently deflected against the power terminal 332. The second contact 404 includes a spring beam 408 configured to be resiliently deflected against the IDC contact 405. The spring beams 406, 408 allow expansion and contraction of the variable resistive member 400 therebetween. The pocket 392 is also sized to allow expansion and contraction of the variable resistive member 400.

In an exemplary embodiment, the variable resistive member 400 includes a positive temperature coefficient resistive member that varies resistance based on temperature similar to the variable resistive member 200 described above. For example, the resistance may increase as the temperature increases. The variable resistive member 400 includes a conductive polymer member with conductive particles immersed in a non-conductive polymer. Increased resistive heating caused by current flowing through the variable resistance path of the variable resistive member 400 causes the non-conductive polymer to expand to disrupt conductive paths formed by interconnected conductive particles.

Figure 14:
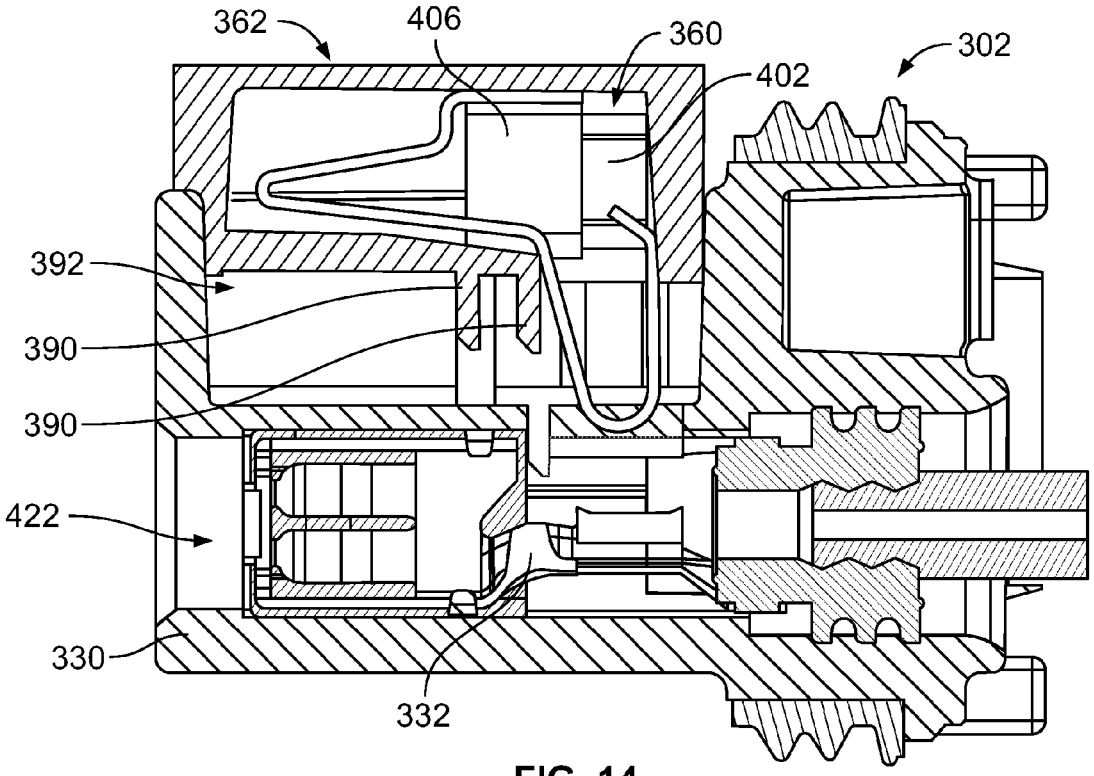
FIG. 14 is a cross-sectional view of the electrical connector shown in FIG. 12 showing a TPA device in an open position.
Figure 15:
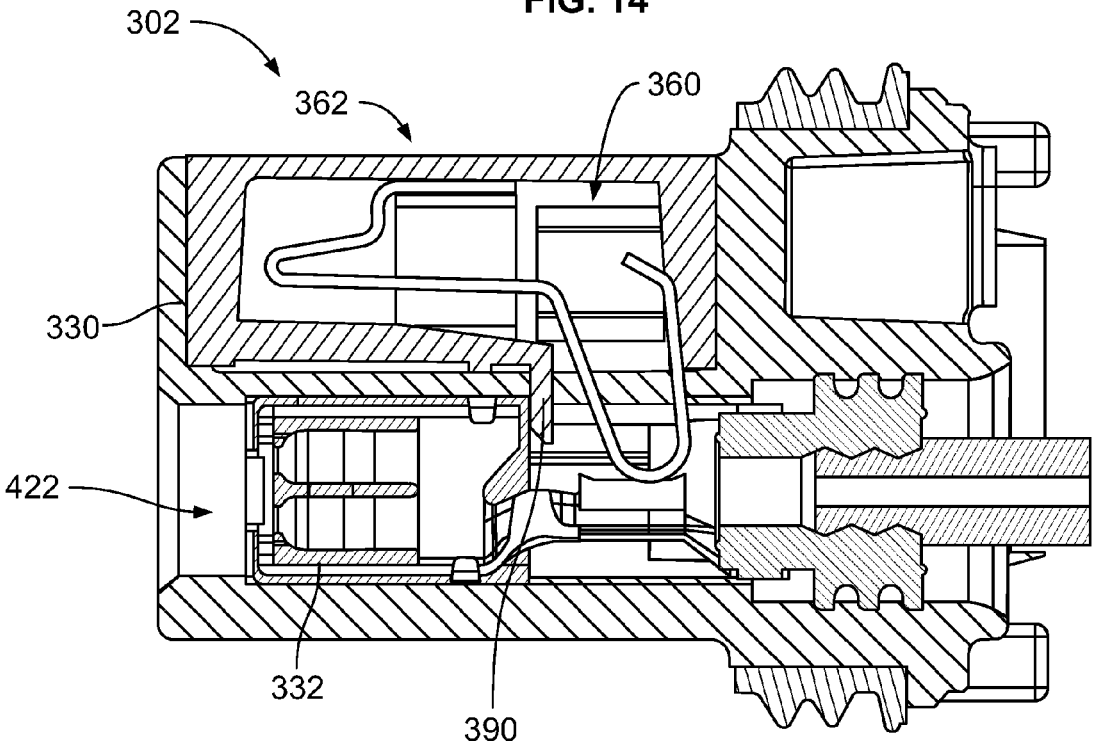
FIG. 15 is a cross sectional view of the electrical connector shown in FIG. 12 showing the TPA device in a blocking position.

FIG. 14 is a cross-sectional view of the electrical connector 302 showing the TPA device 362 in an open position. FIG. 15 is a cross sectional view of the electrical connector 302 showing the TPA device 362 in a blocking position. The TPA device 362 is top loaded into the pocket 392. The PTC 360 is movable with the TPA device 362 to engage the corresponding power terminal 332. For example, the spring beam 406 of the first contact 402 is configured to engage the power terminal 332 when the TPA device 362 is in the closed or blocking position. In the illustrated embodiment, the spring beam 406 engages the crimp of the power terminal 332; however the spring beam 406 may engage other portions of the power terminal 332.

In the open position (FIG. 14), the TPA device 362 allows the power terminals 332 to be unloaded from the housing 330 and loaded into the housing 330. After the power terminals 332 are loaded into the housing 330, the TPA device 362 may be moved to the blocking position (FIG. 15) to block removal of the power terminals 332. The block 390 is configured to be positioned behind the corresponding power terminal 332 to block removal of the power terminals 332. In an exemplary embodiment, the TPA device 362 includes two blocks 390 that are offset or staggered to correspond to the staggered power terminals 332.

In an exemplary embodiment, the housing 330 includes terminal channels 422 that receive corresponding power terminals 332 and an auxiliary terminal channel 424 (shown in FIG. 12) that receives the auxiliary power terminal. The power terminals 332 may be loaded into the corresponding terminal channels 422 through the rear of the housing 330. The power terminals 332 may be held in the corresponding terminal channels 422 by latches or other securing features. The TPA device 362 may act as a secondary securing feature to secure the power terminals 332 in the corresponding terminal channels 422.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector matable to and unmatable from a separable mating electrical connector, the electrical connector comprising:

a housing having a terminal channel and an auxiliary terminal channel;

a power terminal received in the terminal channel, the power terminal being matable with and unmatable from a mating power terminal of the mating electrical connector;

an auxiliary power terminal received in the auxiliary terminal channel;

a terminal position assurance (TPA) device movably coupled to the housing and movable between an open position and a blocking position, the TPA device blocking removal of the power terminal from the terminal channel when in the blocking position; and a protective thermal coupler held by and movable with the TPA device, the protective thermal coupler having a variable resistive member electrically coupled between the power terminal and the auxiliary power terminal, the variable resistive member providing a shunt so that arcing does not occur when the power terminal is disconnected from the mating power terminal of the mating electrical connector.

2. The electrical connector of claim 1, wherein the protective thermal coupler is electrically coupled to the power terminal at a separable mating interface coupled to the power terminal when the TPA device is in the blocking position and separated from the power terminal when the TPA device is in the open position.

3. The electrical connector of claim 1, wherein electrical resistance in the variable resistance member increases in response to increasing voltage/current to reduce the flow of voltage/current through the auxiliary power terminal before the auxiliary power terminal is disconnected from an auxiliary mating terminal of the mating connector so that arcing does not occur when the auxiliary power terminal is disconnected initially causing an increase in the flow of voltage/current through the variable resistance member.

4. The electrical connector of claim 3, wherein an increase in resistance in the variable resistance member lags an increase in current.

5. The electrical connector of claim 1, wherein the variable resistance member comprises a conductive polymer member with conductive particles immersed in a nonconductive polymer, increased resistive heating causing the nonconductive polymer to expand to disrupt conductive paths formed by interconnected conductive particles.

6. The electrical connector of claim 1, wherein the power terminal has a mating end and the auxiliary power terminal has a mating end, the mating ends being staggered with the mating end of the auxiliary power terminal forward of the mating end of the power terminal such that the power terminal is disconnected before the auxiliary power terminal as the electrical connector is unmated from the mating electrical connector.

7. The electrical connector of claim 1, wherein the protective thermal coupler includes a first contact coupled to the power terminal and a second contact coupled to the auxiliary power terminal, the variable resistive member being electrically connected between the first contact and the second contact, the variable resistive member providing a variable resistance path through the electrical connector immediately after disconnection of the power terminal from the mating power terminal of the mating electrical connector but while the auxiliary power terminal remains connected to an auxiliary mating terminal of the mating electrical connector.

8. The electrical connector of claim 7, wherein the first contact comprises a spring beam resiliently deflected against the power terminal when the TPA device is in the blocking position.

9. The electrical connector of claim 1, wherein the housing comprises an outer housing having a chamber configured to receive at least a portion of the mating electrical connector, and wherein the housing comprises an inner housing positioned in the outer housing, the inner housing including the terminal channel and the auxiliary terminal channel, the TPA device being received in the inner housing in the blocking position, the TPA device being at least partially positioned exterior of the inner housing in the chamber in the open position to block mating of the electrical connector with the mating electrical connector.

10. The electrical connector of claim 1, wherein the power terminal defines a first power terminal, the electrical connector further comprising a second power terminal received in the housing, the first and second power terminals having staggered mating ends with the mating end of the second power terminal forward of the mating end of the first power terminal such that the first power terminal is disconnected before the second power terminal as the electrical connector is unmated from the mating electrical connector.

11. The electrical connector of claim 1, wherein the variable resistive member comprises a positive temperature coefficient resistive member, the variable resistive member is characterized in that an increase in electrical resistance of the variable resistive member lags an inrush current through the variable resistive member so that the variable resistive member carries a current approximately equal to the inrush current for a period of time referred to as a trip time, and wherein the power terminal is disconnected from the mating power terminal of the mating electrical connector prior to disconnection of the auxiliary power terminal from a mating auxiliary terminal of the mating electrical connector, the time to disconnect the power terminal by a distance sufficient such that an electrical arc cannot be sustained comprising a disconnect time, the disconnect time being less than the trip time so that arcing is prevented upon disconnection of the power terminal.

12. The electrical connector of claim 1, wherein the auxiliary terminal is disconnected from an auxiliary mating terminal after a finite time interval from the disconnecting of the power terminal from the mating power terminal of the mating electrical connector, the finite time interval being long enough for resistance in the variable resistive member to increase sufficiently to reduce the current through the auxiliary terminal below an arcing threshold so that arcing does not occur upon disconnection of the auxiliary terminal.

13. The electrical connector of claim 1, wherein the variable resistive member comprises a positive temperature coefficient resistive member characterized by a finite trip time to switch from a first relatively low resistance state to a second relatively higher resistance state.

14. The electrical connector of claim 1, wherein the variable resistive member comprises a positive temperature coefficient resistive member, a resistance of the positive temperature coefficient resistor increases sufficiently rapidly between separation of the power terminal and disconnection of the auxiliary terminal so that the electrical energy flowing through the auxiliary terminal is reduced below the arcing threshold after separation of the power terminal and before disconnection of the auxiliary terminal.

15. An electrical connector matable to and unmatable from a separable mating electrical connector, the electrical connector comprising:

a housing having a terminal channel and an auxiliary terminal channel;

a power terminal received in the terminal channel, the power terminal being matable with and unmatable from a mating power terminal of the mating electrical connector;

an auxiliary power terminal received in the auxiliary terminal channel;

a terminal position assurance (TPA) device movably coupled to the housing and movable between an open position and a blocking position, the TPA device blocking removal of the power terminal from the terminal channel when in the blocking position; and a protective thermal coupler held by and movable with the TPA device, the protective thermal coupler having a variable resistive member electrically coupled between the power terminal and the auxiliary power terminal;

wherein the power terminal is separable from the mating power terminal before the auxiliary power terminal is disconnected from a circuit including the mating power terminal of the mating electrical connector so that the resistance in the variable resistive member increases after disconnection of the main power terminal from the mating power terminal and prior to disconnection of the auxiliary power terminal from the circuit so that both the main power terminal and the auxiliary power terminal can be disconnected without arcing.

16. The electrical connector of claim 15, wherein electrical resistance in the variable resistance member increases in response to increasing voltage/current to reduce the flow of voltage/current through the auxiliary power terminal before the auxiliary power terminal is disconnected from an auxiliary mating terminal of the mating connector so that arcing does not occur when the auxiliary power terminal is disconnected.

17. The electrical connector of claim 15, wherein the power terminal has a mating end and the auxiliary power terminal has a mating end, the mating ends being staggered with the mating end of the auxiliary power terminal forward of the mating end of the power terminal such that the power terminal is disconnected before the auxiliary power terminal as the electrical connector is unmated from the mating electrical connector.

18. The electrical connector of claim 15, wherein the protective thermal coupler includes a first contact coupled to the power terminal and a second contact coupled to the auxiliary power terminal, the variable resistive member being electrically connected between the first contact and the second contact, the variable resistive member providing a variable resistance path through the electrical connector immediately after disconnection of the power terminal from the mating power terminal of the mating electrical connector but while the auxiliary power terminal remains connected to an auxiliary mating terminal of the mating electrical connector.

19. The electrical connector of claim 15, wherein the variable resistive member comprises a positive temperature coefficient resistive member, the variable resistive member is characterized in that an increase in electrical resistance of the variable resistive member lags an inrush current through the variable resistive member so that the variable resistive member carries a current approximately equal to the inrush current for a period of time referred to as a trip time, and wherein the power terminal is disconnected from the mating power terminal of the mating electrical connector prior to disconnection of the auxiliary power terminal from a mating auxiliary terminal of the mating electrical connector, the time to disconnect the power terminal by a distance sufficient such that an electrical arc cannot be sustained comprising a disconnect time, the disconnect time being less than the trip time so that arcing is prevented upon disconnection of the power terminal.

20. An electrical connector matable to and unmatable from a separable mating electrical connector, the electrical connector comprising:

a housing having a terminal channel and an auxiliary terminal channel, the housing having a pocket;

a power terminal received in the terminal channel, the power terminal being matable with and unmatable from a mating power terminal of the mating electrical connector;

an auxiliary power terminal received in the auxiliary terminal channel, the auxiliary power terminal being matable with and unmatable from a mating auxiliary terminal of the mating electrical connector;

a terminal position assurance (TPA) device received in the pocket of the housing, the TPA device including a block having a blocking surface, the TPA device being movably coupled to the housing between an open position and a blocking position, the block of the TPA device being positioned behind the power terminal to block removal of the power terminal from the terminal channel when in the blocking position; and a protective thermal coupler held by and movable with the TPA device, the protective thermal coupler having a first contact coupled to the power terminal and a second contact coupled to the auxiliary power terminal, the protective thermal coupler having a variable resistive member between the first contact and the second contact and being electrically coupled between the power terminal and the auxiliary power terminal, the variable resistive member providing a variable resistance path through the electrical connector immediately after disconnection of the power terminal from the mating power terminal of the mating electrical connector.

* * * * *